United States Patent [19]

Potts

[11] Patent Number: 4,498,934

[45] Date of Patent: Feb. 12, 1985

[54] MACHINE AND METHOD FOR CLEANING RECEPTACLES IN A SINGLE IMMERSION CHAMBER HAVING A SOAKING STATION AND A SCRUBBING STATION

[75] Inventor: Roger F. Potts, Georgetown, Canada

[73] Assignee: Convay Systems Limited, Canada

[21] Appl. No.: 408,365

[22] Filed: Aug. 16, 1982

Related U.S. Application Data

[63] Continuation-in-part of Ser. No. 147,622, May 7, 1980, Pat. No. 4,344,448, and a continuation-in-part of Ser. No. 360,872, Mar. 22, 1982.

[30] Foreign Application Priority Data

Jul. 31, 1979 [CA] Canada ..... 332924

[51] Int. Cl.[3] ..... B08B 3/02

[52] U.S. Cl. ..... 134/254; 134/10; 134/29; 134/30; 134/74; 134/83; 134/105; 134/108

[58] Field of Search ..... 134/73, 83, 105, 108, 134/184, 74, 110, 1, 10, 25.2, 25.3, 25.4, 29, 30, 75

[56] References Cited

U.S. PATENT DOCUMENTS

| | | | |
|---|---|---|---|
| 1,356,055 | 10/1920 | Elick | 134/73 X |
| 2,010,497 | 8/1935 | Skinner | 134/10 X |
| 2,635,614 | 4/1953 | Ford | 134/74 X |
| 3,024,138 | 3/1962 | Schlott | 134/10 X |
| 3,044,474 | 7/1962 | Veeder | 134/73 |
| 3,109,439 | 11/1963 | Evans et al. | 134/74 |
| 3,129,713 | 4/1964 | Read | 134/25.2 X |
| 3,868,960 | 3/1975 | Cove et al. | 134/73 |
| 4,170,241 | 10/1979 | Clapp | 134/184 X |
| 4,344,448 | 8/1982 | Potts | 134/73 |

FOREIGN PATENT DOCUMENTS

| | | | |
|---|---|---|---|
| 282887 | 3/1971 | U.S.S.R. | 134/83 |
| 417188 | 8/1974 | U.S.S.R. | 134/1 |
| 452941 | 5/1975 | U.S.S.R. | 134/83 |

*Primary Examiner*—S. Leon Bashore
*Assistant Examiner*—K. M. Hastings
*Attorney, Agent, or Firm*—Remy J. VanOphem

[57] ABSTRACT

A method for cleaning dirty objects using cleaning fluid and rinsing fluid and an apparatus using the method. The method has consecutive steps of spraying the surface of a dirty object with high pressure spray of cleaning fluid, immersing the dirty object in an immersion chamber containing cleaning fluid, spraying additional cleaning fluid at high pressure into the immersion chamber at a location downstream from the initial location where the dirty object is immersed to turbulate cleaning fluid therein to scrub the surface of the dirty object, removing the dirty object from the immersion chamber, and spraying the surface of the dirty object with a high pressure spray of rinsing fluid.

30 Claims, 13 Drawing Figures

MACHINE AND METHOD FOR CLEANING RECEPTACLES IN A SINGLE IMMERSION CHAMBER HAVING A SOAKING STATION AND A SCRUBBING STATION

CONTINUING INFORMATION

The present application is a continuation-in-part of application Ser. No. 147,622, filed May 7, 1980 now issued as U.S. Pat. No. 4,344,448, and is further a continuation-in-part application of application Ser. No. 360,872, filed Mar. 22, 1982. The specification, drawings, and claims of the parent application are hereby incorporated into the present application.

FIELD OF THE INVENTION

The present invention relates to improvements in a cleaning apparatus and process. More particularly, the present invention relates to a method and an apparatus for automatically cleaning dirt from the surfaces of dirty objects by a washing apparatus using high pressure jet sprays to agitate the cleaning fluid in an immersion bath.

BACKGROUND OF THE INVENTION

Litter and its impact on our environment is receiving increased national attention. In response to this problem, some states have enacted legislation which has banned the use of throw-away plastic, glass, and metal beverage bottles. Recent studies have shown that this legislation has reduced the amount of litter on our highways and other public property. However, this legislation has also created other unforeseen problems in the storage and return of returnable beverage bottles.

It is common practice in the beverage industry to use plastic receptacles for shipping glass, plastic and metal beverage containers. These plastic receptacles are normally formed with a plurality of stiffening flanges and ribs which form a large number of crevices within which dirt can accumulate. In some instances, the plastic receptacles are composite structures which include removable secondary enclosures. For hygenic and aesthetic purposes, it is desirable to clean these receptacles each time they are returned to the bottling plant.

The art of cleaning an object by dipping it in an acidic or basic cleaning solution so that the chemical solution attacks the surface contaminants is well known. This method is economical and requires only the most simple equipment. However, it is also time consuming and does not always clean the crevices and holes in the object being so processed. Furthermore, the cleaning solution often attacks the surface of the object itself and, after a substantial number of cleaning cycles, may have a permanent detrimental effect on the appearance of the surface.

Cleaning objects by placing them in a liquid bath and transmitting ultrasonic waves through the fluid in the bath to impinge upon the surface of the object is also well known. An example of a cleaning apparatus using ultrasonic waves is disclosed in the parent application to the present case. The ultrasonic cleaning method is more effective at removing dirt than merely immersing the object in a chemical bath. Unfortunately, as the length of time that any one object is immersed in the bath is decreased, the number of transducers needed to properly clean the object is increased to make ultrasonics effective, there must be at least one transducer element per gallon of cleaning fluid. While batch cleaning using ultrasonics is well known, it is sometimes extremely expensive to use ultrasonic cleaning equipment to adequately clean objects in a very high volume production line situation. Furthermore, ultrasonic transducers only loosen the dirt but do not remove the dirt unless there is sufficient exposure time and a sufficient amount of ultrasonic energy. A thorough rinse is therefore essential to remove the dirt from the object. Finally, all ultrasonic cleaners have the disadvantage of being incapable of removing large pieces of debris from the crevices and cavities of the subject being cleaned. Such pieces of debris as straw, broken glass and bottle caps are often found within the plastic receptacles used by the beverage industry when they are returned to the bottling plant.

One method that has been used to increase the effectiveness of ultrasonic cleaning devices is to provide a pre-wash station where the object is scrubbed prior to being immersed in the ultrasonic immersion bath. In the pre-wash station, the object may, for example, be exposed to the scrubbing action of a high pressure spray of cleaning fluid. One disadvantage with the use of a pre-wash station is that the cleaning fluid from the pre-wash station cannot be permitted to flow into the immersion chamber. If the cleaning fluid from the pre-wash station is allowed to flow into the immersion chamber and to mix with the cleaning fluid therein, the effectiveness of the ultrasonic transducers will be greatly decreased.

In the parent application to the present application, it was proposed that a cleaning apparatus be provided with a liquid immersion bath combining a chemical and a mechanical cleaning action. The chemical cleaning action was provided by using a cleaning fluid which reduces the surface tension of the dirty object and of the dirt itself. The mechanical cleaning action was provided by either transducers or a series of high pressure spray jets which agitated the fluid in the bath. While this apparatus produced the desirable result of decreasing the number of transducers needed for a predetermined amount of dirt removal, the apparatus still required the use of more caustic chemicals in the cleaning fluid than may be desirable. Furthermore, the specific apparatus disclosed did not suggest that the fluid from the pre-wash station could be permitted to be mixed with the fluid in the immersion bath.

SUMMARY OF THE INVENTION

The present invention provides a novel method for cleaning dirty objects and further provides a novel apparatus using the method. In the method of the present invention, the dirty object is first pre-washed with a high pressure spray adapted to impinge directly on the surface of the dirty object to remove a portion of the dirt from the surface of the object. The object is then immersed in an immersion chamber containing heated cleaning fluid for a predetermined period of time. After the object has been immersed in the cleaning fluid in the immersion chamber for the predetermined period of time, the cleaning fluid is agitated by high pressure jets. The high pressure jets are adapted to create substantial turbulence in the cleaning fluid so that additional dirt is loosened and removed from the surface of the object and so that large pieces of debris are lifted away from the object. Finally, the object is removed from the immersion bath and is rinsed with a high pressure spray of rinsing fluid adapted to impinge directly on the surface of the subject to remove the cleaning fluid and remaining dirt from the object.

In the preferred embodiment, the method is applied to a continuous process for cleaning multiple dirty objects. Thus, the dirty objects are first passed through a pre-wash chamber where they are exposed to the scrubbing action of several high pressure spray jets of cleaning fluid. The initial scrubbing action removes or loosens a portion of the dirt. Next, the objects are passed through a longitudinally extending immersion chamber having a soaking station and a scrubbing station. In the soaking station, additional dirt is loosened by the cleaning fluid. In the scrubbing station of the immersion chamber, addtional dirt is loosened and removed from the object by the vigorous mechanical scrubbing action of tubulence created by a high pressure fluid distributor. Finally, the remaining dirt is removed from the object by passing the object through a rinse chamber. In the rinse chamber the surfaces of the objects are exposed to a high pressure spray of a rinsing fluid or wetting agent which removes the dirt from the object and also assists in drying the object.

The apparatus of the present invention is characterized by a housing. A pre-wash chamber is provided at the input end of the housing. The pre-wash chamber has a first spray tunnel mounted therein for spraying cleaning fluid directly at the surfaces of the dirty objects. A rinse chamber is provided at the discharge end of the housing. The rinse chamber has a second spray tunnel mounted therein for spraying rinsing fluid directly at the surface of the objects. An immersion chamber is provided in the housing between the pre-wash chamber and the rinse chamber. A high pressure fluid distributor is mounted in the portion of the immersion chamber nearest the rinse chamber. A transporting apparatus for moving the objects serially through the pre-wash chamber, the immersion chamber and the rinse chamber are provided. Guide bars are mounted in the housing for guiding the objects serially through the wash chamber, the immersion chamber and the rinse chamber.

The cleaning apparatus further is provided with a filtering apparatus interconnected with the portion of the immersion chamber nearest the pre-wash chamber to remove therein at least a portion of the dirt dissolved in the cleaning fluid. A first high pressure pump is provided for drawing cleaning fluid from the filtering apparatus, pressuring the cleaning fluid to a predetermined pressure level and delivering the pressurized cleaning fluid to the first spray tunnel. A second high pressure pump is provided to draw cleaning fluid from the filtering chamber, pressurize the cleaning fluid to a predetermined pressure level and deliver the pressurized cleaning fluid to the high pressure fluid distributor.

It is therefore the primary object of the present invention to provide a cleaning apparatus which will remove dirt from dirty objects and will effectively clean a dirty object in one pass through the apparatus. To accomplish this, the surface tension of the dirt and of the object is reduced by the action of the cleaning fluid in the soaking station of the immersion chamber. Another portion of the dirt is loosened and the loosened dirt is removed by the vigorous scrubbing action of the turbulent cleaning fluid in the scrubbing station of the immersion chamber. The remaining portion of the dirt and the cleaning fluid residue is removed from the object by the vigorous mechanical scrubbing action of the rinsing fluid from the high pressure fluid distributor.

It is a further object of the present invention to provide an inexpensive cleaning apparatus adapted for a high volume batch operation.

It is yet a further object of the present invention to provide a high pressure fluid cleaning apparatus in which a transporting apparatus is provided to drive multiple dirty objects through the apparatus so as to maintain the dirty objects in a longitudinally spaced relationship.

Still another object of this invention is to provide a method of cleaning objects by a mechanical and chemical cleaning process which minimizes the amount of caustic chemical required for satisfactory cleaning of the dirty objects.

It is still another object of the present invention to provide an apparatus which will mechanically and chemically remove dirt from dirty objects in one pass. To achieve this object, a portion of the dirt is loosened and removed by the vigorous mechanical scrubbing action and by the chemical action of the cleaning fluid from high pressure jets of the first spray tunnel. Another portion of the dirt is loosened by immersion of the object into the heated cleaning fluid in the soaking station of the immersion chamber. Still another portion of the dirt is loosened and removed by the vigorous scrubbing action of the turbulent and agitated cleaning fluid in the scrubbing station of the immersion chamber. The remaining dirt and the cleaning fluid residue is removed from the object by the vigorous mechanical scrubbing action of rinsing fluid from the high pressure spray jets of the second spray tunnel.

Yet another object of this invention is to provide an apparatus which will mechanically and chemically remove dirt from dirty objects and will mechanically remove large pieces of debris from the objects. This is accomplished by the vigorous action of the turbulent and agitated cleaning fluid in the scrubbing station of the immersion chamber.

A still further object of the invention is to provide an apparatus which mechanically and chemically removes dirt from dirty objects in which a transporting apparatus is mounted in a pre-wash chamber, immersion chamber and rinse chamber. The transporting apparatus is adapted to drive dirty objects in a longitudinally spaced relationship through the apparatus. Thus, the entire outer surface of the dirty object is exposed to the scrubbing action of the high pressure spray jets in the pre-wash chamber, the action of the cleaning fluid in the soaking station, the scrubbing action of the turbulent cleaning fluid in the scrubbing station, and the scrubbing action of the high pressure spray jets in the rinse chamber.

Still another object of the present invention is to provide a method for cleaning objects by combining the mechanical and chemical cleaning from a process utilizing high pressure spray jets with the mechanical cleaning from a process utilizing an immersion bath which contains heated and agitated chemical fluid. In addition, the method utilizes high pressure spray jets in a rinse chamber in order to fully clean the object.

The many objects, features, and advantages of the present invention will become apparent to those skilled in the art when the following detailed description is read in conjunction with the drawings attached hereto.

DETAILED DESCRIPTION OF THE PREFERRED EMBODIMENT

Figure 1:
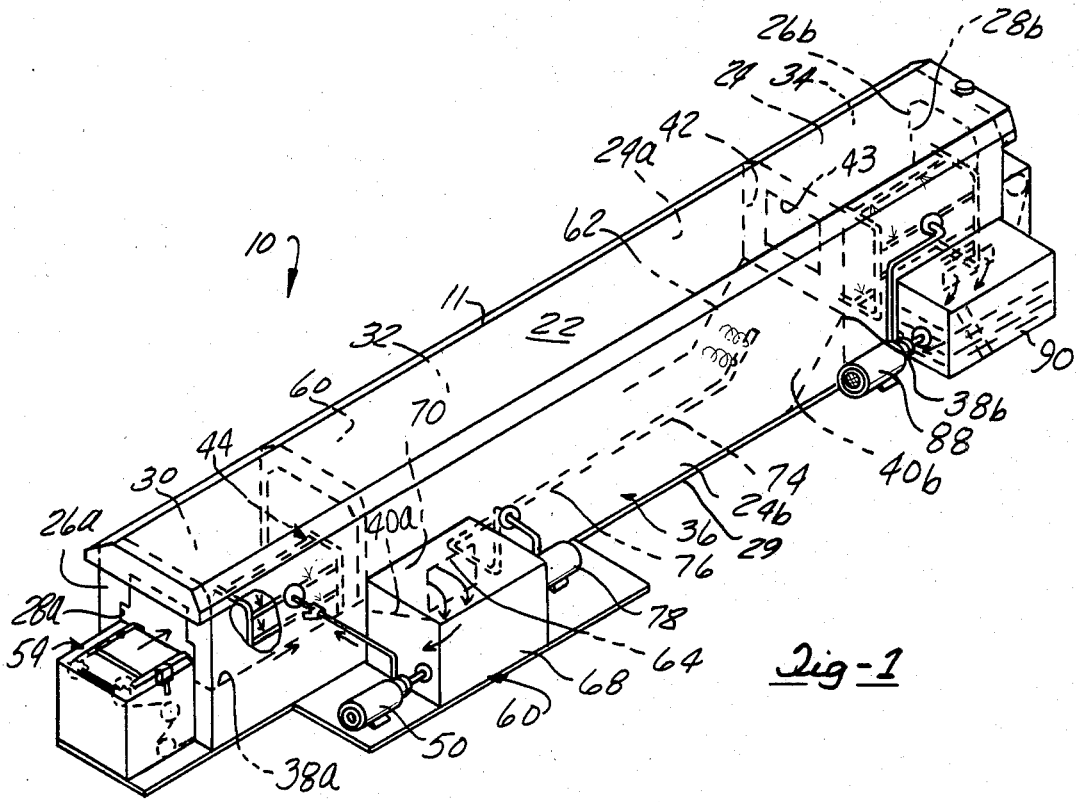
FIG. 1 is a perspective view of an example of the cleaning apparatus of the present invention having a pre-wash chamber, an immersion chamber, and a rinse chamber.

Referring now to the drawings, and more particularly FIGS. 1 through 4 thereof, an example of an apparatus for cleaning dirty objects is generally designated by the reference numeral 10. In the example illustrated, the dirty object to be cleaned is a plastic receptacle 12 (FIG. 2) for soft drink bottles. The plastic receptacle 12 has a bottom wall 14, four sidewalls 16*a* through 16*d*, and two handles 18*a* and 18*b*. The receptacle 12 has an internal compartment 20 for storing soft drink bottles. Those skilled in the art will recognize that the cleaning apparatus 10 also has application for cleaning other dirty objects such as plastic, wood, metals or other containers used in dairy, meat, confectionary, bakery and other food industries. The present invention also has application for cleaning plastic members, machine parts and similar dirty objects.

As shown in FIG. 1, the cleaning apparatus 10 is enclosed within a housing 11 having a longitudinally extending top wall 22, two longitudinally extending sidewalls 24*a* and 24*b* and two end walls 26*a* and 26*b*. One of the end walls, end wall 26*a*, is provided with an inlet passage 28*a* for admission of receptacles 12 into the housing 11. The other of the end walls, end wall 26*b*, is provided with an outlet passage 28*b* through which receptacles 12 exit the housing 11 after they have been cleaned. The housing 11 of the cleaning apparatus 10 is further provided with a bottom wall or floor 29, described later. The walls of the housing 11 may be thermally insulated to reduce the heat loss from the fluids within the chambers nd to thereby minimize the energy cost associated with maintaining the fluids at a desired temperature.

The interior of the housing of the cleaning apparatus 10 is divided into a pre-wash chamber 30, an immersion chamber 32 and a rinse chamber 34 serially arranged between the inlet passage 28*a* and the outlet passage 28*b*. The details and the function of each of the chambers 30 through 34 within the housing of the cleaning apparatus 10 will be described in detail shortly.

Figures 3, 4, 7, 8, 10:
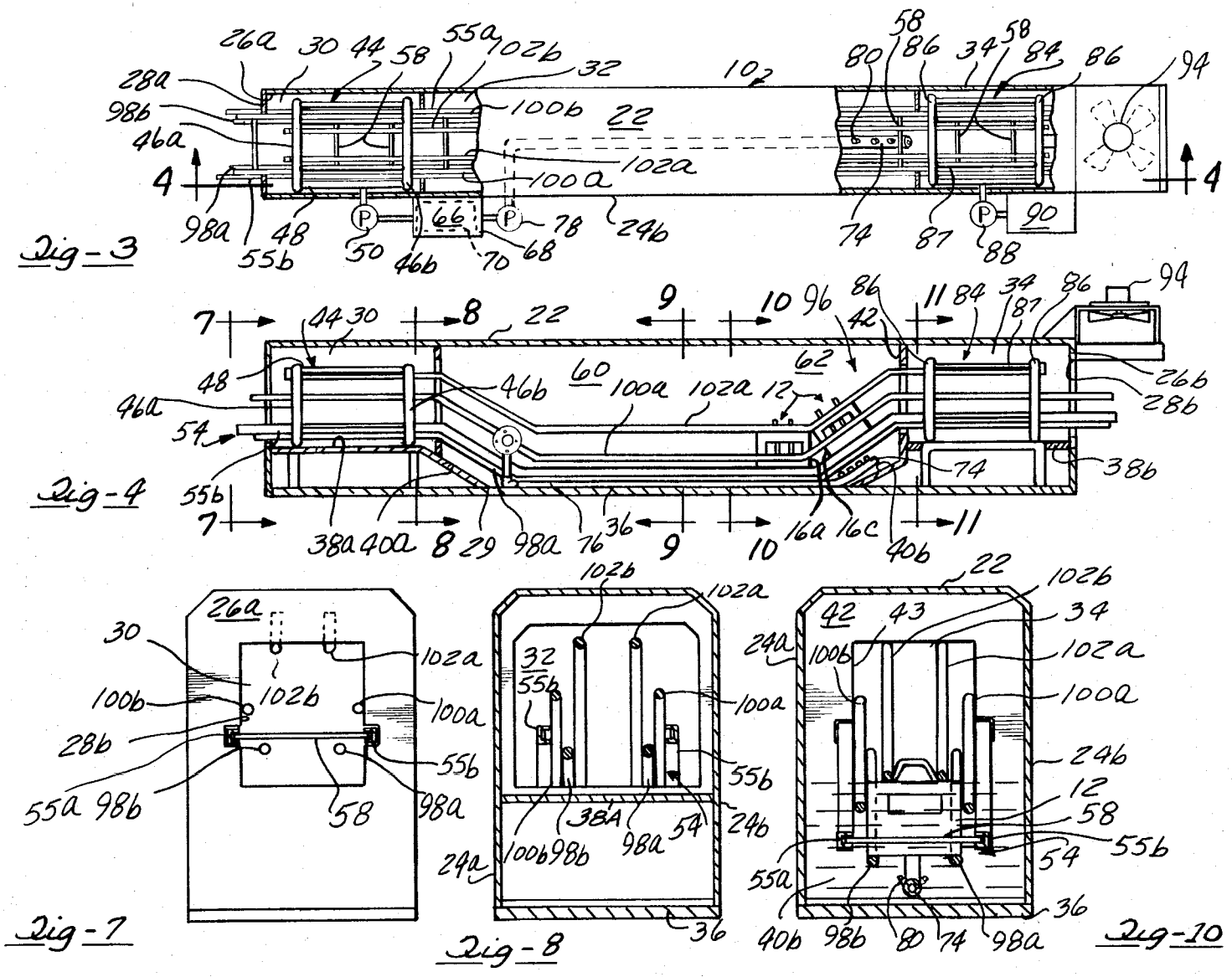
FIG. 3 is a partially cut-away top view of the cleaning apparatus of FIG. 1.
FIG. 4 is a partially cut-away side view of the cleaning apparatus of FIG. 1.
FIGS. 7 through 11 are partial sectional views of the cleaning apparatus of FIG. 4 taken, respectively, along the lines 7—7 through 11—11 thereof.

As best shown in FIGS. 1 and 4, the floor 29 has a horizontal central portion 36 in the central portion of the immersion chamber 32. The floor 29 further has horizontal end portions 38*a* and 38*b* located in the pre-wash chamber and the rinse chamber, respectively. The horizontal end portions 38*a* and 38*b* are each located in a plane above the central portion 36. Intermediate sloping floor portions 40*a* and 40*b* are provided within the immersion chamber 32 between the end portions 38*a* and 38*b*, respectively, and the central portion 36. An additional vertical wall 42 is provided between the immersion chamber 32 and the rinse chamber 34. A passage 43 is provided through the wall 42 for the receptacles 12.

Figure 5:
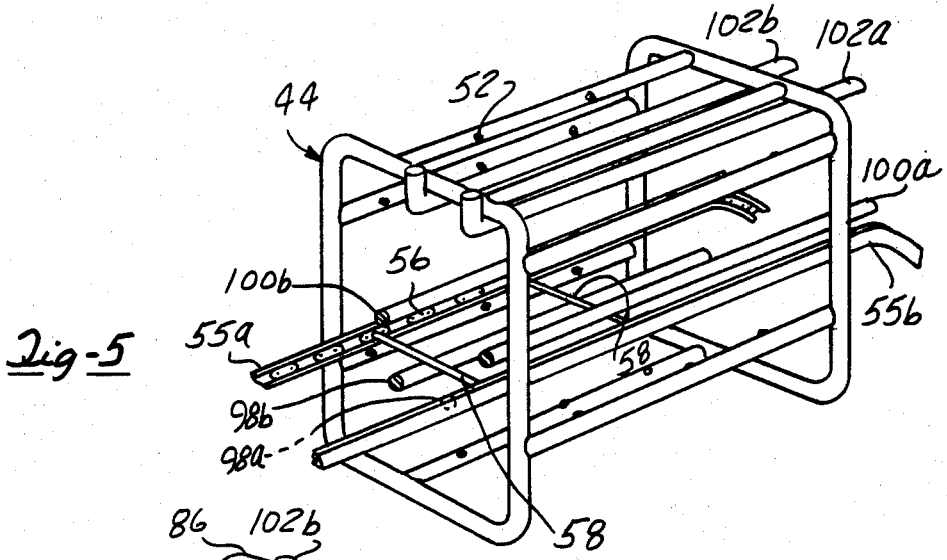
FIG. 5 is a perspective side view of a spray tunnel and a portion of a feed conveyor which is provided within the pre-wash chamber of the cleaning apparatus of FIG. 1.

The details of the pre-wash chamber 30 are best illustrated in FIGS. 3 through 5. The pre-wash chamber 30 contains a first spray assembly or tunnel 44. The first spray assembly 44 includes a pair of tubular end frame members 46*a* and 46*b* which are arranged to form an open rectangle. Several tubular cross members 48 are mounted longitudinally between the tubular end frame 46*a* and 46*b* members. The first spray assembly 44 is fed by a high pressure pump (FIGS. 1 and 3) 50 which receives cleaning fluid withdrawn from a cleaning fluid recirculating apparatus 66, described later herein. The pump 50 delivers cleaning fluid at a pressure in the range of seventy to eighty (70–80) psig to the first spray assembly 44. The preferred delivery pressure is seventy-five (75) psig. Several spray nozzles 52 are mounted to the tubular cross members 48 so as to direct several spray jets of cleaning fluid into the interior of the first spray assembly 44 and directly at the surface of the receptacle 12. The spray nozzles 52 are selected so as to maintain a high pressure over a great distance and have an aperture of approximately eighty thousands of an inch 0.080 in the preferred embodiment. The high pressure spray jets produced by the nozzles 52 form high velocity streams which mechanically scrub the dirty object so as to loosen or remove a portion of the dirt from the receptacle. The combination of the scrubbing action of the fluid spray and the chemical action of the cleaning fluid loosens or removes a portion of the dirt from the dirty receptacle. The cleaning fluid within the pre-wash chamber 30 is permitted to flow freely from the pre-wash chamber into the immersion chamber.

Figure 2:
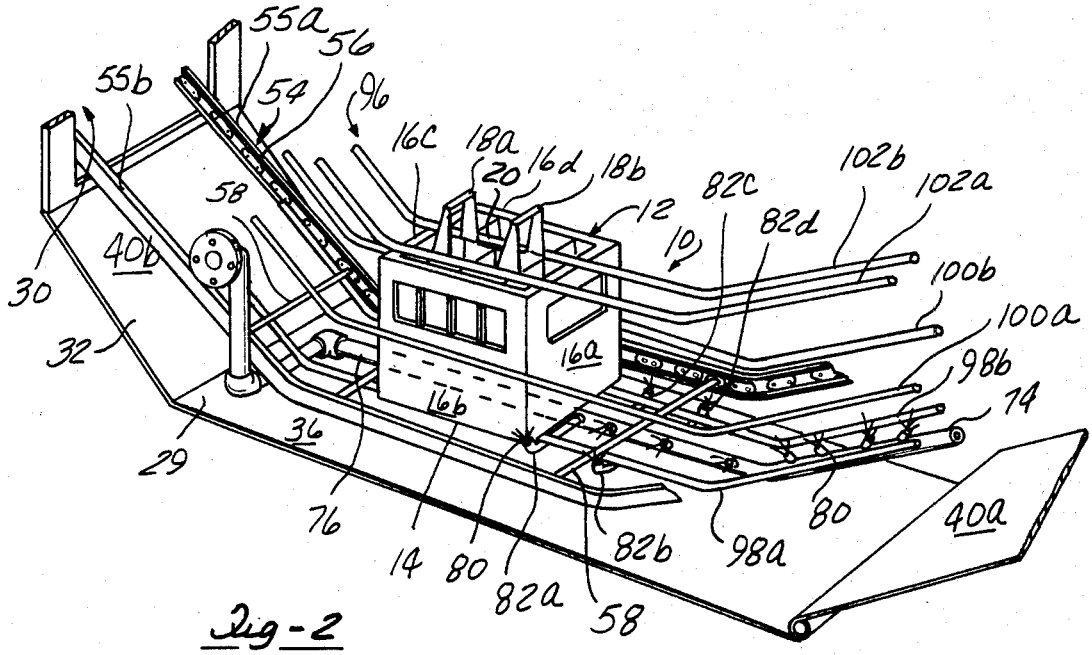
FIG. 2 is an enlarged perspective view with parts cut-away of the immersion chamber of the cleaning apparatus of FIG. 1 and illustrates internal components of the cleaning apparatus and a dirty object capable of being cleaned by the cleaning apparatus.

The details of the immersion chamber 32 are best shown in FIGS. 2 through 4. The immersion chamber bath 32 is filled to a predetermined level with a chemical or cleaning fluid preferably containing a non-foaming agent. The type and concentration of the cleaning fluid depends on the nature of the dirt to be removed and the degree of cleaning required. Many appropriate fluids are well known in the art and are commercially available. In the example illustrated in the drawing, one percent to two percent detergent in the cleaning fluid has been found to be acceptable.

The immersion chamber is functionally divided into a soaking station 60 for pre-soaking the receptacles 12 and a scrubbing station 62 for scrubbing the receptacle 12.

The soaking station 60 of the immersion chamber 32 is located near the pre-wash chamber 30. The soaking station 60 is provided to permit the cleaning fluid to act to reduce the surface tension of the receptacle 12 and the dirt on the receptacles. A drain passage 64 shown in FIG. 1 in the side wall 24*b* of the housing permits a portion of the cleaning fluid to be drawn from the soaking station 60 into the cleaning fluid recirculating apparatus 66. The drain passage 64 is preferably located in the first one third of the immersion chamber 32 so as not to reduce the turbulence of the fluid in the latter one half to one third of the immersion chamber.

The fluid recirculating apparatus 66 has a housing 68 defining a fluid tank 70. A filtering apparatus (not shown) is provided within the fluid tank 70 for removing dirt from the cleaning fluid therein.

The scrubbing station 62 of the immersion chamber 32 is located near the rinse chamber 34. The scrubbing station 62 is provided with a high pressure fluid distributor 74 or 74' adapted to agitate the cleaning fluid in the latter portion of the immersion chamber 32. Two examples of structure for a high pressure fluid distributor 74 or 74' shown in the drawing, one example being illustrated in FIGS. 2 through 11 and the other example being illustrated in FIGS. 12 through 13.

In the first example of structure, best depicted in FIGS. 2, 3 and 10, the fluid distributor 74 consists of a long main tubular element 76 interconnected at one of its ends to a high pressure pump 78. The high pressure pump 78 draws recycled cleaning fluid from the fluid recirculating apparatus 66 and pressurizes the fluid to a pressure of 45 to 50 psig.

The fluid distributor 74 further has a series of spray nozzles 80 permitting the pressurized fluid within the tubular element 76 to exit the element 76 in the form of several high pressure streams. The spray nozzles 80 are choosen so as to deliver a high pressure and high slow spray of cleaning fluid into the immersion chamber. In the preferred embodiment, the nozzles have apertures of about one quarter of an inch (0.25"). Additionally, the fluid distributor 74 has several tubular arms 82*a* through 82*d* interconnected with the tubular element 76 and extending radially therefrom. Additional spray nozzles 80 are provided at the end of each of the arms 82*a* through 82*d*. The cleaning fluid from the distributor 74 thus agitates the cleaning fluid in the immersion chamber 32. The agitated cleaning fluid scrubs the surfaces of the receptacles 12 to remove dirt from the surfaces.

Figure 12:
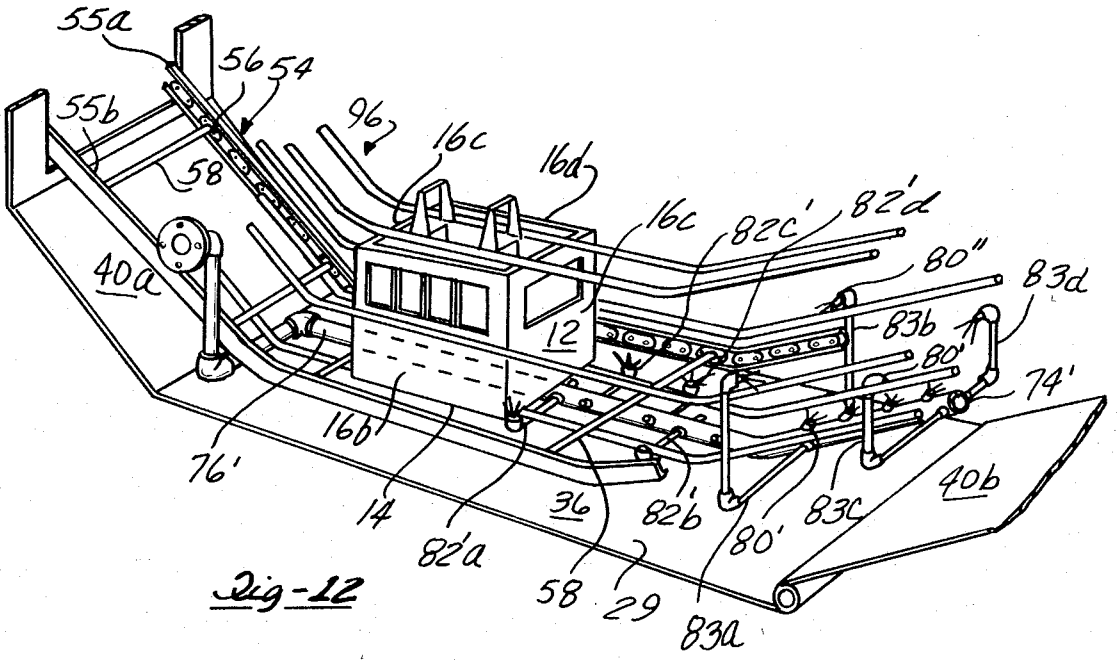
FIG. 12 is a perspective view similar to FIG. 2 and illustrates a modified cleaning apparatus according to the invention.
Figure 13:
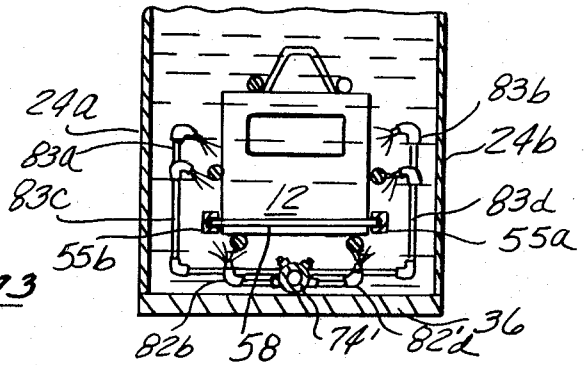
FIG. 13 is a sectional view similar to that illustrated in FIG. 10 and depicts the high pressure spray jets in the immersion chamber of the cleaning apparatus of FIG. 12.

The second example of structure for a distributor 74' is shown in FIGS. 12 and 13. As with the distributor described above, the distributor 74' has several radial arms 82'*a* through 82'*d* interconnected with a long main element 76'. Each of the arms 82'*a* through 82'*d* is provided with a spray nozzle 80' to agitate the cleaning fluid. Additionally, the distributor 74' has several "L" shaped arms 83*a* through 83*d* interconnected with the element 76' and each provided with a spray nozzle 80'. The various locations and orientations of the nozzles will depend on the size and shape of the article to be cleaned and the surfaces which must require scrubbing. The majority of dirt on the receptacles 12 has been found on the side walls 16*a* through 16*d*. The hardest part of the dirt to remove, however, has been found to be on the bottom wall 14. A substantial number of the nozzles 80' are therefore located below the receptacle 12. The spray nozzle 80' that are directed towards the bottom wall 14 of the receptacle 12 from the distributor 74' are upstream of the spray nozzles 80' on the arms 83*a* through 83*d* and therefore create more turbulence due to their greater pressure.

A heating apparatus (not shown) may also be provided within the immersion chamber 32 to heat the cleaning fluid to a determined temperature, preferably in the range of 150°–160° F. Appropriate heating apparatus are commercially available and are well known to those skilled in the art.

Figure 6:
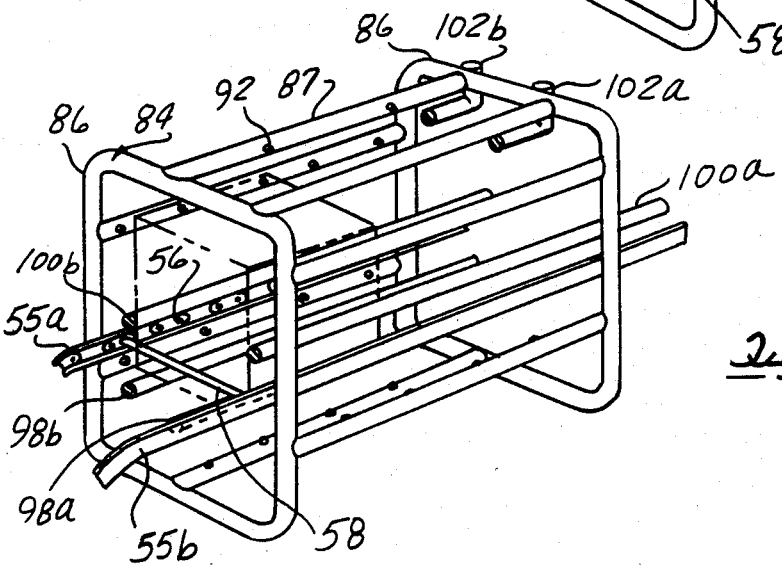
FIG. 6 is a perspective side view of a spray tunnel which is provided within the rinse chamber of the cleaning apparatus of FIG. 1.
Figure 9:
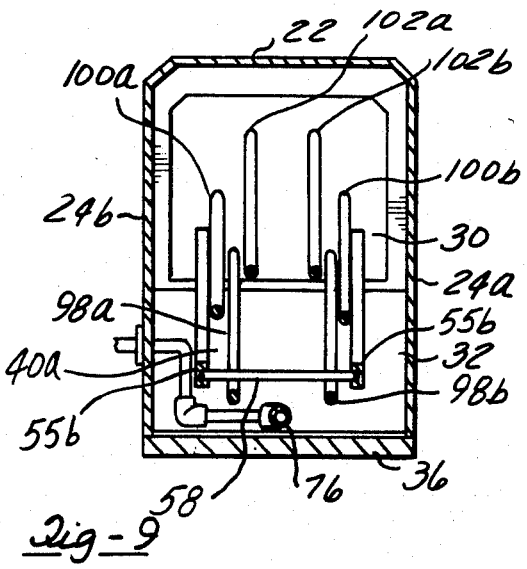
Figure 11:
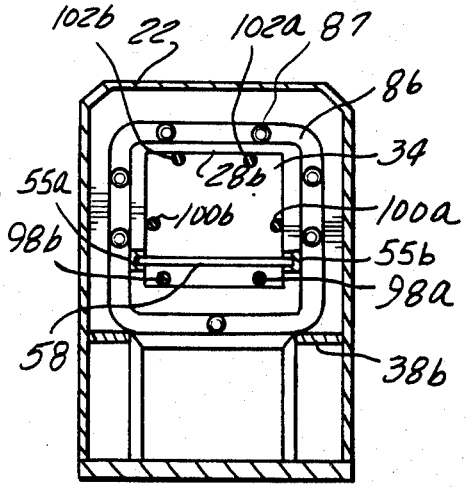

The details of the rinse chamber 34 are best shown in FIGS. 1, 3, 4 and 6. As shown in FIG. 4, the rinse chamber 34 contains a second spray tunnel or assembly 84 similar to the first spray assembly 44 described in the pre-wash chamber 30. The second spray assembly 84, as shown in FIG. 6, has a pair of tubular end frame members 86 which are arranged to form an open rectangle and several tubular cross members 87 which are mounted longitudinally between the tubular end frame members. The second spray assembly 84 is supplied with fluid by a high pressure pump 88 which receives rinse water withdrawn from a tank 90. A plurality of spray nozzles 92 are mounted to the cross members 87 so as to direct a plurality of high pressure spray jets of rinse fluid into the second spray assembly 84. Those skilled in the art will recognize that the rinse water in the tank 90 must be separated from the cleaning fluid in the tank 70 by a wall. The rinse fluid from the second spray assembly 84 is sprayed onto the receptacles in the rinse chamber 34 at a pressure of 70 to 80 psig from the pump 88 in order to remove the remaining dirt and residual cleaning fluid from the receptacle. The preferred pressure is 75 psig. Thus, the high pressure rinse fluid spray jets produce high velocity streams which mechanically scrub the remaining dirt from the objects and rinse any residual cleaning fluid adhering to the objects. The fluid in the tank 90 may be heated by any convenient conventionally available heater member. The removal of liquid from the objects after they have passed through the rinse chamber 34 may be accomplished by a fan 94 (FIGS. 3 and 4) which blows air (shown only in FIG. 3), optionally heated, over the receptacles.

The receptacles 12 to be cleaned are to be entirely immersed in the cleaning fluid in the immersion bath in order to loosen all the dirt from the surfaces of the object to be cleaned. In order to achieve this with dirty objects which are less dense than water, such as plastic receptacles 12, a mechanical guidance system is provided to insure that the objects to be cleaned are held entirely below the surface of the cleaning fluid during their passage through the immersion chamber 32. The receptacles may be directed through the apparatus 10 along a guide assembly 96 (best shown in FIG. 2). The guide assembly 96 extends serially through the pre-wash chamber 30, through the immersion chamber 32 and through the rinse chamber 34.

The guide assembly 96 has two lower guide rails 98*a* and 98*b* arranged in a spaced apart relationship to each other and adjacent to the opposite sides of the guide assembly 96 (FIGS. 2 and 4). The lower guide rails 98*a* and 98*b* extend first horizontally in the pre-wash chamber 30, then angularly downward to the entrance of the immersion chamber 32 to direct the objects downwardly below the level of the cleaning fluid in the immersion chamber 32. Adjacent to the bottom of the immersion chamber 32, the lower guide rails 98*a* and 98*b* extend first horizontally and then angularly upwardly through the passage 43 in the wall 42. Finally, the lower guide rails 98*a* and 98*b* extend horizontally through the rinse chamber 34.

The guide assembly 96 also includes two side support rails 100*a* and 100*b* arranged opposite to each other, above the lower guide rails 98*a* and 98*b* and at opposite sides of the receptacles 12. These side support rails 100*a* and 100*b* extend through the pre-wash chamber 30, through the immersion chamber 32 and through the rinse chamber 34 in a similar way as the lower guide rails 98*a* and 98*b*. The guide assembly 96 also includes a pair of top guide rails 102*a* and 102*b* which are arranged opposite each other above the side support rails 100*a* and 100*b* and at opposite sides of the guide assembly 96. The top guide rails 102*a* and 102*b* extend through the pre-wash chamber 30, immersion chamber 32 and rinse chamber 34, in a similar way to the side support rails 100*a* and 100*b*.

A conveyor assembly 54 is mounted in the housing. The conveyor assembly 54 extends horizontally into and through the pre-wash chamber 30, the immersion chamber 32, and the rinse chamber 34. The guide assembly 96 receives dirty receptacles 12 placed thereon by an operator or by another conveyor (not shown). The conveyor assembly 54 pushes each receptacle 12 along the guide assembly 96 and maintains the receptacles 12 in longitudinally spaced apart relationship. The longitudinal spacing of the receptacles 12 permits the high pressure spray jets of the cleaning fluid in the pre-wash chamber 30 and of the rinsing fluid in the rinse chamber 34 to impinge on the leading and trailing side walls 16*a* and 16*c* of each receptacle. Furthermore, the angular spacing of adjacent receptacles (see FIG. 4) passes through the scrubbing station and permits the turbulent cleaning fluid therein to better scrub the leading and trailing side walls 16*a* and 16*c*.

Details of the conveyor assembly 54 may be seen in FIGS. 1 through 3. The conveyor assembly 54, shown in the drawing, is well known in the art and is available commercially. While other means for conveying the receptacles 12 through the housing are possible, the conveyor assembly 54 is preferred. The conveyor assembly 54 has two tracks 55*a* and 55*b*, each extending through the pre-wash chamber 30, the immersion chamber 32 and the rinse chamber 34 on opposite sides of the guide assembly 96. The conveyor assembly 54 also has two continuous chains 56, one for each of the tracks 55*a* and 55*b*. Each of the chains 56 (only one of which is shown, in part, in the drawings) extends from a drive mechanism (not shown) along the entire length of one of the tracks 55*a* and 55*b* through the housing 11 and returns also in a manner well known in the art, but not shown in the drawing, to the drive mechanism. The conveyor assembly 54 further has several push rods 58 extending between the two continuous chains 56. The push rods 58 are spaced apart a predetermined distance exceeding the length of the receptacles 12. The receptacles 12 are delivered to the conveyor assembly 54 in a manner such that one receptacle is provided between each adjacent pair of push rods 58 and is pushed along the guide assembly 96 by the push rod 58 adjacent to the trailing side walls 16*c* of the receptacle.

OPERATION

On operation, a batch of dirty receptacles 12 are delivered to the inlet passage 28*a* of the cleaning apparatus 10. The conveyor assembly 54 serves to space the dirty objects from one to the other so that high pressure spray of the first spray assembly 44 can be applied directly to the entire surface of each receptacle 12 including the leading sidewall (wall 16*a* in FIG. 2) and the trailing sidewall (wall 16*c* in FIG. 2) thereof. Thus, the scrubbing action of the high pressure spray jets impinging on the surface of the receptacles, combined with the chemical action of the cleaning fluid acts to loosen or remove a portion of the dirt from the receptacles.

The receptacles 12 are directed by the conveyor assembly 54 from the pre-wash chamber 30 into the immersion chamber 32 and are guided along the guide assembly 96 therethrough. In the soaking station 60 of the immersion chamber 32, the heated cleaning fluid reduces the surface tension of the dirt and of the dirty receptacle. The cleaning fluid within this initial portion of the immersion chamber 32 is not agitated for reasons that will become apparent shortly.

The receptacles 12 are directed by the conveyor assembly 54 from the soaking station 60 into the scrubbing station 62 of the immersion chamber 32. In the scrubbing station 62, the cleaning fluid is agitated to scrub the surfaces of the receptacle 12. The cleaning fluid may be agitated to such an extent that large pieces of debris such as straws, broken glass, and caps will be removed from the receptacles.

Preferably, the nozzles 80 of the fluid distributor in the scrubbing station of the immersion chamber 32 are adapted to agitate only the final half or final third of the immersion chamber.

This is done since the scrubbing action of turbulent cleaning fluid in the initial portion of the immersion chamber 32 is less effective than the scrubbing action of turbulent fluid in the final portion of the immersion chamber. During the time that the receptacle 12 is in the soaking station of the immersion chamber, the cleaning fluid acts to reduce the surface tension holding the dirt to the receptacle. Heating the cleaning fluid, referred to earlier by means of a heating appartus in the immersion chamber 32, assists in this process and reduces the time necessary for the cleaning fluid to act on the dirt and the surface of the receptacle. Once the surface tension has been reduced, the tubulent cleaning fluid will quickly and efficiently scrub the dirt from the receptacle. Thus, for the same amount of flow and pressure delivered by the pump 78, a better cleaning result is obtained by having a spray nozzles 80 only in the final portion of the immersion chamber 32.

The receptacles 12 are finally directed by the conveyor assembly 54 from the immersion chamber 32 into and through the rinse chamber 34 where the entire surface of each receptacle 12 is rinsed by the high pressure spray of the second spray assembly 84.

It is therefore readily apparent that the present invention provides an economical cleaning method and apparatus for cleaning dirty objects. The method and the apparatus described are particularly of value for high volume situations where a substantial number of dirty objects must be rapidly, reliably and economically cleaned. The method and the apparatus combine chemical and mechanical cleaning techniques in an efficient manner to minimize the amount of caustic chemical that must be used for cleaning the objects. The method and apparatus are therefore adapted for cleaning dirty objects including materials which cannot withstand the use of harsh cleaning fluids. Finally, the method and the apparatus provide a means for reliably cleaning all surfaces of the dirty objects and for removing pieces of debris from within the objects.

The above description of the preferred embodiment is provided by way of example and not by way of limitation. The above description includes the best mode contemplated by the inventor for carrying out the present invention at the time of filing the present application. Variations from the above description will be apparent to those skilled in the art and are intended to be within the scope of this invention which is to be limited only by the claims attached to this specification.

What is claimed as novel is as follows:

1. An apparatus for removing dirt from a dirty object using cleaning fluid and rinsing fluid, said apparatus comprising:

an immersion chamber containing cleaning fluid and provided with an inlet for the entry of said dirty object at one of its ends and an outlet for the exit of said dirty object at the other of its ends, so that said dirty object is completely immersed in said cleaning fluid when passing through said immersion chamber and so that said cleaning fluid acts upon the surfaces of said dirty object to loosen said dirt;

a first high pressure spray means mounted adjacent to said inlet for spraying cleaning fluid directly at the surfaces of said dirty object so that a portion of said dirt is loosened and removed from said dirty object before said dirty object is immersed in said immersion chamber;

a second high pressure spray means mounted within said immersion chamber a predetermined distance from said inlet for spraying cleaning fluid into said immersion chamber for turbulating said cleaning fluid in said immersion chamber, so that said turbulated cleaning fluid acts upon the surfaces of said dirty object to loosen an additional portion of said dirt and to remove said portion of said loosened dirt from said dirty object as it passes through said immersion chamber after said dirty object has been immersed in said cleaning fluid for a predetermined period of time;

a third high pressure spray means mounted adjacent to said outlet for spraying rinsing fluid directly at the surfaces of said dirty object after said dirty object has passed through said immersion chamber, so that the remaining dirt and the cleaning fluid adhering to said dirty object is removed therefrom; and a transporting means progressively moving said dirty object through said first high pressure spray means, said immersion chamber, and said third high pressure spray means.

2. The apparatus of claim 1 wherein said predetermined distance is at least two thirds of the distance between said inlet and said outlet.

3. The apparatus of claim 1 wherein said transporting means further comprises conveyor means extending through said first high pressure spray means, said immersion chamber and said second high pressure spray means, for driving multiple dirty objects serially therealong and for maintaining the dirty objects in a longitudinally spaced relationship.

4. The apparatus of claim 1, wherein said first high pressure spray means further comprises a pre-wash chamber; a spray tunnel mounted in said pre-wash chamber, said spray tunnel having a plurality of spray nozzles; a fluid transporting means adapted to deliver cleanining fluid from said pre-wash chamber to said immersion chamber; and a high pressure pump connected to said spray tunnel for flow communication therebetween, said high pressure pump drawing cleaning fluid from said immersion chamber, pressurizing said cleaning fluid to a predetermined pressure, and delivering said pressurized cleaning fluid to said plurality of spray nozzles, whereby said plurality of spray nozzles together spray several high pressure spray jets of cleaning fluid at the surface of said dirty object and mechanically scrub said dirty object with said pressurized cleaning fluid to remove a portion of said dirt from said dirty object.

5. The apparatus of claim 4 wherein said first high pressure spray means further comprises filter means interposed between said immersion chamber and said high pressure pump for removing dirt from said cleaning fluid.

6. The apparatus of claim 1 further comprising means for heating said cleaning fluid to a predetermined temperature and for maintaining said cleaning fluid at said predetermined temperature.

7. The apparatus of claim 1 wherein said transporting means further comprises guide means mounted in said first high pressure spray means, said immersion chamber and said second high pressure spray means for guiding several dirty objects serially therethrough.

8. The apparatus of claim 1 wherein said immersion chamber is generally disposed in a plane below said first high pressure spray means and said third high pressure spray means, and further wherein said transporting means extends first horizontally through said first high pressure spray means, then downwardly along an inclined plane through an initial portion of said immersion chamber, then horizontally through an intermediate portion of said immersion chamber, then upwardly along an inclined plane through a final portion of said immersion chamber, and finally horizontally through said outlet; so that the leading and trailing surfaces of said dirty object are exposed to increased scrubbing action from said turbulated cleaning fluid due to angular variations between trailing and leading surfaces of adjacent dirty objects as they pass through said intermediate and final portions of said immersion chamber.

9. The apparatus of claim 8 further comprising a fluid passage between said first high pressure spray means and said immersion chamber so that cleaning fluid which has been sprayed by said first high pressure spray means at said dirty object is permitted to flow into said immersion chamber.

10. The apparatus of claim 1 wherein said second high pressure spray means further comprises:

a high pressure fluid distribution means mounted in said immersion chamber, said high pressure fluid distribution means comprising at least one fluid passageway having spray apertures; and a high pressure pump drawing cleaning fluid from said immersion chamber, pressurizing said cleaning fluid, and delivering said pressurized cleaning fluid to said at least one fluid passageway of said high pressure fluid distribution means, whereby said pressurized cleaning fluid exits said at least one fluid passageway through said spray apertures in the form of a plurality of high pressure jet sprays which turbulate said cleaning fluid in said immersion chamber.

11. The apparatus of claim 1 wherein said second high pressure spray means further comprises filter means mounted between said immersion chamber and said high pressure pump to remove, from said cleaning fluid, said portion of dirt which has been removed from said dirty object by said second high pressure spray means.

12. The apparatus of claim 10 wherein each of said spray apertures is located at least said predetermined distance from said inlet and further wherein said high pressure pump draws cleaning fluid from a portion of said immersion chamber between said inlet and said spray apertures.

13. The apparatus of claim 1 wherein said third high pressure spray means further comprises a rinse chamber, a spray tunnel mounted in said rinse chamber, said spray tunnel having several spray nozzles, and a pressurized supply of rinsing fluid for said spray tunnel.

14. An apparatus for removing dirt from dirty objects using cleaning fluid and rinsing fluid, said apparatus comprising:

a first spray tunnel;

at least one first spray nozzle in said first spray tunnel for mechanically scrubbing dirty objects with cleaning fluid as said dirty object passes through said first spray tunnel;

a first fluid supply means supplying pressurized cleaning fluid to said at least one first spray nozzle of said first spray tunnel;

a longitudinally extending immersion chamber having two ends, said longitudinally extending immersion chamber being interconnected at one of said two ends with said first spray tunnel and having the other of said two ends disposed remote therefrom, said longitudinally extending immersion chamber containing cleaning fluid for immersing said dirty objects therein as said dirty objects move through said longitudinally extending immersion chamber;

turbulator means in a location along said immersion chamber remote from said first spray tunnel;

at least one second spray nozzle on said turbulator means for turbulating said cleaning fluid in a portion of said immersion chamber spaced a predetermined distance from said one of said two ends of said longitudinally extending immersion chamber such as to turbulate said cleaning fluid in said portion of said immersion chamber;

second fluid supply means supplying pressurized cleaning fluid to said at least one second spray nozzle of said turbulator means;

a second spray tunnel interconnected with said other of said two ends of said longitudinally extending immersion chamber;

at least one third spray nozzle in said second spray tunnel for scrubbing said dirty objects with rinsing fluid as said dirty objects pass through said second spray tunnel;

a third fluid supply means supplying pressurized rinsing fluid to said at least one third spray nozzle of said second spray tunnel; and transporting means for moving said dirty objects serially through said first spray tunnel, said longitudinally extending immersion chamber, and said second spray tunnel.

15. The apparatus of claim 14 wherein said first spray tunnel and said second spray tunnel are disposed in a plane above said longitudinally extending immersion chamber and wherein said cleaning fluid in said first spray tunnel is permitted to flow from said first spray tunnel into said longitudinally extending immersion chamber.

16. The apparatus of claim 15 wherein said first fluid supply means comprises a high pressure pump interconnected with a portion of said longitudinally extending immersion chamber between said one end of said longitudinally extending immersion chamber and said turbulator means, said high pressure pump being adapted to draw cleaning fluid from said portion of said immersion chamber, pressurize said cleaning fluid to a predetermined pressure level, and deliver said pressurized cleaning fluid to said at least one first spray nozzle of said first spray tunnel.

17. The apparatus of claim 16 further comprising a filtering means interposed between said longitudinally extending immersion chamber and said high pressure pump for removing from said cleaning fluid at least a portion of said dirt which has been removed from said dirty objects.

18. The apparatus of claim 14 further comprising a cleaning fluid heating means in said longitudinally extending immersion chamber for increasing the temperature of said cleaning fluid to a predetermined level and for maintaining said temperature of said cleaning fluid at said predetermined level.

19. The apparatus of claim 14 wherein said second fluid supply means comprises a high pressure pump interconnected with a portion of said longitudinally extending immersion chamber between said one end thereof and said turbulator means, said high pressure pump being adapted to draw cleaning fluid from said portion of said longitudinally extending immersion chamber, pressurize said cleaning fluid to a predetermined pressure level and deliver said pressurized cleaning fluid to said at least one second spray nozzle of said second fluid supply means.

20. The apparatus of claim 19 further comprising a filtering means interposed said longitudinally extending immersion chamber and said high pressure pump for removing from said cleaning fluid the dirt which has been removed from said dirty objects by said at least one second spray nozzle and said turbulated cleaning fluid in said portion of said longitudinally extending immersion chamber.

21. The apparatus of claim 14 further comprising a rinsing fluid heating means for increasing the temperature of rinsing fluid delivered to said second spray tunnel to a predetermined level.

22. The apparatus of claim 14 wherein said transporting means further comprises conveyor means extending through said first spray tunnel, said longitudinally extending immersion chamber and said second spray tunnel, and continuously driving said dirty objects serially therealong while maintaining said dirty objects in a longitudinally spaced relationship; and guide means mounted in said first spray tunnel, said longitudinally extending immersion chamber and said second spray tunnel, for guiding said dirty objects therethrough.

23. The apparatus of claim 14 wherein said predetermined distance is two thirds of the length of said longitudinally extending immersion chamber.

24. The apparatus of claim 14 wherein said turbulator means comprises a high pressure fluid distribution means mounted in said longitudinally extending immersion chamber, said high pressure fluid distribution means having a plurality of fluid passageways, each of said plurality of fluid passageways having at least one spray nozzle.

25. A method of removing the dirt from a dirty object using cleaning fluid and rinsing fluid, said method comprising the steps of:

spraying said dirty object with cleaning fluid from a first high pressure spray means so as to remove a first portion of said dirty from said dirty object;

immersing said dirty object in a first portion of an immersion chamber containing cleaning fluid, so as to loosen a second portion of said dirt from said dirty object by the action of said cleaning fluid;

immersing said dirty object in a second portion of said immersion chamber containing cleaning fluid;

turbulating said cleaning fluid using a second high pressure spray means in a second portion of said immersion chamber so as to remove said second portion of said dirt which has been loosened by the action of said cleaning fluid and so as to loosen and remove a third portion of said dirt by the mechanical action of said turbulated cleaning fluid;

rinsing said dirty object with rinsing fluid from a third high pressure spray means so as to remove the remaining dirt from said dirty object and to remove any cleaning fluid adhering to said dirty object; and transporting said dirty objects progressively through said first high pressure spray means, said first portion of said immersion chamber, said second portion of said immersion chamber, and said third high pressure spray means.

26. The method of claim 25 further comprising before said immersing step the additional step of heating said cleaning fluid to an elevated temperature and still further comprising the step of maintaining said cleaning fluid at said elevated temperature during said immersing step and said spraying step.

27. A continuous method for removing the dirt from a series of dirty objects using cleaning fluid and rinsing fluid, said method comprising the steps of:

serially moving said series of dirty objects into a first spray tunnel;

continuously spraying each of said series of dirty objects in said first spray tunnel with high pressure streams of cleaning fluid, so that a first portion of said dirt is loosened and removed from said series of dirty objects;

serially advancing said series of dirty objects from said first spray tunnel into a soaking station of an immersion chamber containing said cleaning fluid so that a second portion of said dirt is loosened from said series of dirty objects;

serially advancing said series of dirty objects through said immersion chamber from said soaking station thereof to a scrubbing station thereof;

continuously turbulating said cleaning fluid in said scrubbing station of said immersion chamber with high pressure fluid jets so that a third portion of said dirt is mechanically loosened and said second and third portions of said dirt are removed from each of said series of dirty objects within said scrubbing station by the scrubbing action of said turbulated cleaning fluid;

serially advancing said series of dirty objects from said scrubbing station of said immersion chamber into a second high pressure spray tunnel;

continuously spraying said series of dirty objects in said second high pressure spray tunnel with high pressure streams of rinsing fluid whereby the remaining dirt from said series of dirty objects and said cleaning fluid adhering to said series of dirty objects are mechanically removed therefrom; and serially advancing said series of dirty objects from said second high pressure spray tunnel.

28. The method of claim 27 wherein each preselected dirty object of said series of dirty objects is within said scrubbing station of said immersion chamber during approximately one third of the total time that said preselected dirty object is within said immersion chamber.

29. The method of claim 27 comprising the steps of:

directing a portion of said cleaning fluid from said soaking station of said immersion chamber into a filtration chamber;

filtering said cleaning fluid in said filtration chamber, to collect said dirt which has been removed from said dirty objects; and resupplying at least a portion of said filtered cleaning fluid from said filtration chamber to said immersion chamber.

30. The method of claim 29 further comprising between said filtering step and said resupplying step the steps of directing said portion of said filtered cleaning fluid from said filtration chamber which is to be resupplied to said immersion chamber to a high pressure pump, pressurizing said cleaning fluid by said high pressure pump, and supplying said pressurized cleaning fluid from said high pressure pump to said high pressure fluid jets in said scrubbing station of said immersion chamber.

* * * * *

UNITED STATES PATENT AND TRADEMARK OFFICE

CERTIFICATE OF CORRECTION

PATENT NO. : 4,498,934

DATED : February 12, 1985

INVENTOR(S) : Roger F. Potts

It is certified that error appears in the above-identified patent and that said Letters Patent is hereby corrected as shown below:

Column 1, line 8, after "1980" insert a comma ---- , ----.

Column 2, line 11, delete "subject" and insert ---- object ----.

Column 3, line 1, delete "subject" and insert ---- object ----.

Column 3, line 16, delete "tubulence" and insert ---- turbulence ----.

Column 3, line 48, delete "pressuring" and insert ---- pressurizing ----.

Column 4, line 53, after "Still" insert ---- yet ----.

Column 5, line 61, delete "chambers nd" and insert ---- chambers and ----.

UNITED STATES PATENT AND TRADEMARK OFFICE

CERTIFICATE OF CORRECTION

PATENT NO. : 4,498,934

DATED : February 12, 1985

INVENTOR(S) : Roger F. Potts

It is certified that error appears in the above-identified patent and that said Letters Patent is hereby corrected as shown below:

Column 6, line 24, delete "46a and 46b members" and insert ---- members 46a and 46b ----.

Column 6, line 55, before "fluids" insert ---- cleaning ----.

Column 7, line 67, delete "determined" and insert ---- predetermined ----.

Column 8, line 1, delete "ratus" and insert ---- ratuses ----.

Column 10, line 39, delete "a spray" and insert ---- spray ----.

Column 14, line 64, delete "dirty", first occurrence, and insert ---- dirt ----.

Signed and Sealed this

*Seventeenth* Day of *September 1985*

[SEAL]

*Attest:*

DONALD J. QUIGG

*Attesting Officer*

*Commissioner of Patents and Trademarks—Designate*